United States Patent [19]

Austin

[11] 4,168,552

[45] Sep. 25, 1979

[54] ADJUSTABLE TOILET SEAT

[76] Inventor: Paul G. Austin, 649 N. Kellogg Ave., Santa Barbara, Calif. 93111

[21] Appl. No.: 937,103

[22] Filed: Aug. 28, 1978

[51] Int. Cl.[2] ..... A47K 13/00

[52] U.S. Cl. ..... 4/237; 4/251; 4/185 L; 4/254

[58] Field of Search ..... 4/251, 420, 300, 237, 4/234, 185 L, 252 R, 239, 240, 254; 297/DIG. 4, DIG. 10

[56] References Cited

U.S. PATENT DOCUMENTS

| | | | |
|---|---|---|---|
| 3,060,458 | 10/1962 | Burke | 4/237 |
| 3,458,872 | 8/1969 | Hallstrom et al. | 4/237 |
| 3,594,831 | 7/1971 | Brewer | 4/237 |
| 3,925,833 | 12/1975 | Hunter | 4/251 |
| 4,034,426 | 7/1977 | Hardwick et al. | 4/185 L |
| 4,091,473 | 5/1978 | Matthews et al. | 4/420 |

*Primary Examiner*—Henry K. Artis
*Attorney, Agent, or Firm*—Jack C. Munro

[57] ABSTRACT

A toilet seat to be raised or lowered over a conventiona toilet bowl by a power control operated by the user. A pair of jacks, each having a rotary drive shaft, are disposed on each side of the bowl and are connected to a mounting plate which support the seat. The two jacks shafts are mechanically interconnected through a drive, which is located rearwardly and beneath the toilet bowl so that each jack will be raised or lowered the same distance thereby avoiding tilting. The mechanical interconnection is preferably a belt to lesson operating noise, but a chain and sprocket assembly could be used. A reversible electric motor acts as a power source to operate the drive. One jack shaft is pivotly mounted on its supporting base so as to adjust the position of its connected drive shaft to thereby tighten the belt type of drive to which the drive shaft is connected. A protective cover is located above the drive shaft to prevent any portion of the users clothing from becoming entangled within the drive.

3 Claims, 4 Drawing Figures

ADJUSTABLE TOILET SEAT

BACKGROUND OF THE INVENTION

This invention relates to a toilet seat which can be varied in height to assist invalids and hosptial patients in utilizing toilets. This invention makes it possible for the user to control a motor that adjusts the height of the toilet seat to any desired level.

Toilets commonly found in homes, hospitals and convelescent facilities are generally too low for invalids to use, both in seating themselves and in rising from the seat. For persons of little strength, it is often impossible for them to be seated without falling and impossible to rise from the seat without help. The same difficulties occur to some arthritic persons, ill persons and hospital patients. These individuals have to be assisted to become seated and to arise from the seat. This is not only embarrassing, it requires the help of a nurse or other assistant, when otherwise the individual might be reasonably ambulatory and take care of himself.

It is well known that such persons that are handicapped by weakness or illness can use toilets that have elevated seats. There is less difficulty in becoming seated due to the fact that the persons center of gravity is not appreciably lowered. This same maintenance of the individuals center of gravity assists in rising from the toilet seat. These elevated seats, therefore, are highly desirable for weak or ill persons.

Various attempts have been me at providing seats of adjustable heights for the toilets of invalids. Some structures use two hydraulic jacks, one on each side of the seat, but these have the drawback of differential lift and one side might be higher than the other. Other attempts have been made to mount the seat on a rectangular vertical frame in an attempt to keep the seat level. Still others use adjustable props that rest upon the toilet bowl. Few of these prior art structures appear to be satisfactory primarily due to their complexity.

SUMMARY OF THE INVENTION

The structure of this invention is believed to be summarily described in the Abstract of the Disclosure and reference to be had thereto.

The primary objective of this invention is to construct a non-complex structure for the raising and the lowering of a toilet seat which can be manufactured relatively inexpensively and easily adapted to existing toilet hardware and can be easily operated by persons handicapped by weakness or illness.

DETAILED DESCRIPTION OF THE SHOWN EMBODIMENT

Figure 1:
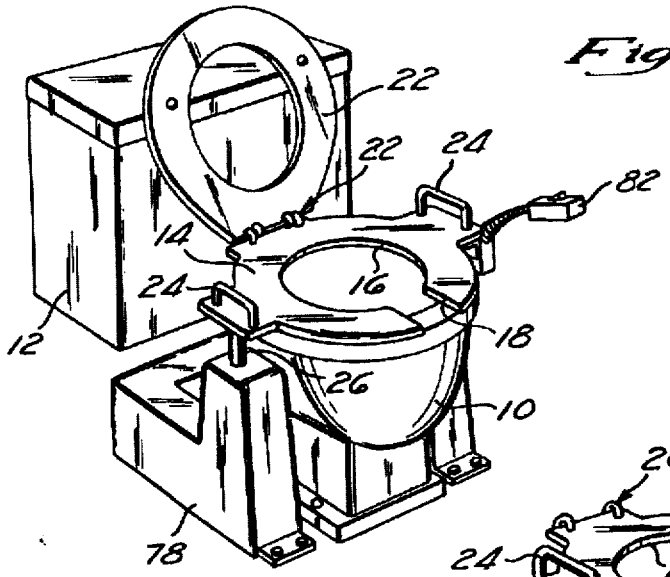
FIG. 1 is an isometric view of the structure of this invention showing how it would be installed and in use with a conventional toilet structure.
Figure 2:
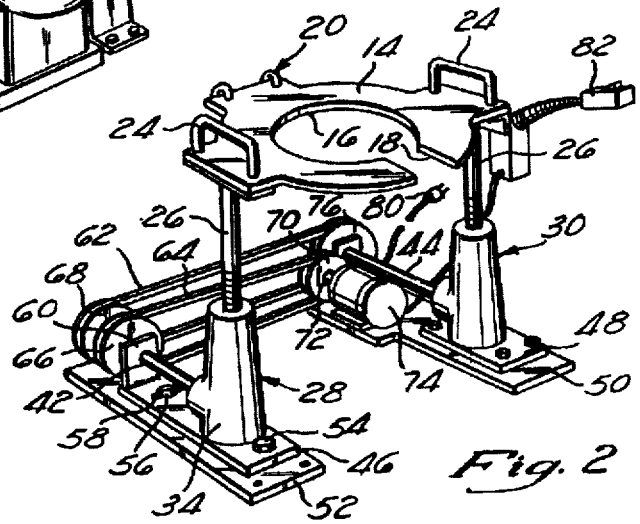
FIG. 2 is a view similar to FIG. 1 with the toilet structure having been removed and the protective housing which covers the drive means included within the structure of this invention having been removed.

Referring particularly to the drawings there is shown a conventional toilet bowl 10 which has attached to the back end thereof a water supply tank 12. The structure of this invention includes the use of a mounting plate 14 which has an interior opening 16. The opening 16 connects with an open slot 18 formed at the front end of the plate 14. The rear end of the plate 14 includes a hinge assembly 20. A toilet seat 22 is pivotly connected by the hinge assembly 20 to the mounting plate 14.

Located on each lateral side of the mounting plate 14 is a handle 24. The handles 24 are to be grasped by the user to facilitate his position on the toilet seat 22 when the seat is in the down position located against the plate 14.

Attached to the underside of the plate 14 and on opposite sides there are a pair of threaded rods 26. One of the threaded rods 26 connects with the first jack assembly 28 with the other of the threaded rods 26 connecting with the second jack assembly 30. The jack assemblies 28 and 30 are basically identical in construction and the threaded rod 26 of each is threadably connected to a rotatable nut 32. The nut 32 is vertically established in position against the flange 36 located within the jack housing 34. However, the nut 32 is capable of rotational movement in respect to the flange 36 with rotation thereof being accomplished by means of a bevel gear 38 which is operatively connected to a drive gear 40. The drive gear 40 is secured to a rotational jack shaft 42. The equivalent rotational shaft of the jack shaft assembly 30 is rotational shaft 44.

The jack shaft assembly 28 is fixedly secured to a supporting base plate 46. The second jack shaft assembly 30 is fixedly mounted on a supporting base plate 48. The supporting base plate 48 is fixedly secured by a conventional fastener means to a fixed base plate assembly 50. A supporting base plate 46 is adjustably mounted upon a fixed base plate assembly 52. Within the forward end of the plate 46 there is located a conventional circular opening through which a first fastener 54 is employed. A second fastener 56 is located through an inwardmost opening 58 which takes the form of an elongated slot formed within the supporting base plate 46. The shaft 42 extends through an upstanding extension 60 of the supporting base plate 46. The upstanding extension 60 functions as a bearing for the shaft 42.

By loosening of both fasteners 54 and 56, the supporting base plate 46 can be pivoted about a pivot axis through fastener 54 with fastener 56 being movable along slot 58. Once the desired adjustable adjustment position of the supporting base plate 46 is established, the fasteners 54 and 56 are tightened thereby fixedly securing the supporting base plate 46 to the fixed base 52.

The reason for the adjustable mounting of the jack assembly 28 with respect of the plate 52 is so that the shaft 42 can be moved to tighten drive belts 62 and 64 when desired. The shaft 42 has fixed thereto a pair of pulleys 66 and 68. A pulley 66 connects through belt 64 to a drive pulley 70. The drive pulley 70 is mounted upon a motor drive shaft 72 of a reversible electric motor 74.

Pulley 68 connects through belt 62 to a driven pulley 76. The pulley 76 is in turn fixedly mounted on the shaft 44.

Therefore, it can be seen by operation of the motor 74 both the shafts 42 and 44 are driven in opposite directions at the same rotational speed. This in turn causes the toilet seat 22 to be raised and lowered evenly.

It is to be noted that there is a protective housing 78 located entirely over the aforementioned belt drive assembly and the motor 74 as well as the jack assemblies 28 and 30. The reason for this is that any loose clothing of the user of the structure of this invention would therefore not be able to become entangled in the structure of this invention.

The operation of the motor 74 is by electricity through electrical conductor 80. Selective operation of the motor 74 is accomplished by the user through the use of an electrical switch assembly 82.

Figure 3:
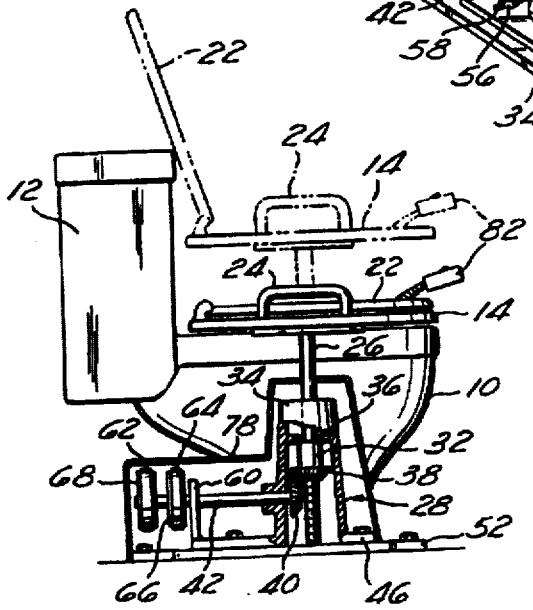
FIG. 3 is a side, cross-sectional view through one of the jack shaft assemblies included with the structure of this invention showing the operation of the toilet seat to the raised or the lowered position.
Figure 4:
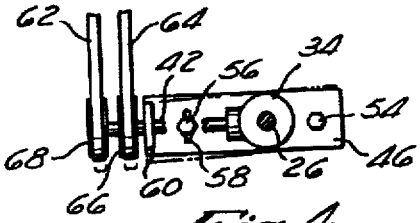
FIG. 4 is a plan, cross-sectional view showing the adjustment mounting feature for one of the jack assemblies.

The operation of the apparatus of this invention is as follows: Once the device has been placed around the conventional toilet bowl such as shown with FIG. 1 of the drawing, the person desiring to use the structure of this invention first stands opposite the assembly and operates the switch 82 to cause the motor 74 to locate the seat 22 at a desired height. The user then baks up to the seat 22. Frequently it is desirable that the seat 22 be at a higher level to assist the invalid in locating himself upon the seat. The invalid at this time operates the switch 82 to lower himself onto the toilet bowl 10. When it is desired for the user to remove himself from the device, the switch 82 is operated to reverse the rotational movement of the motor 74 and move the seat 22 to a raised position which is shown within phantom lines within FIG. 3 of the drawing.

What is claimed is:

1. In combination with a toilet bowl, a toilet bowl seat being movable in respect to said toilet bowl by an adjustment mechanism, a mounting plate, said toilet seat being attached to said mounting plate, handle means attached to said mounting plate, said handle means being located on opposite sides of said toilet seat, said handle means to be grasped by the user, said adjustment mechanism comprising:

a first jack assembly secured to one side of said mounting plate, said seat being mounted on said mounting plate, said first jack assembly being mounted on a first supporting base, said first supporting base being mounted on a fixed base;

a second jack assembly fixedly secured to another side of said mounting plate, said second jack assembly being mounted on a second supporting base, said second supporting base being mounted on said fixed base;

a first rotatable shaft connected to said first jack assembly, a second rotatable shaft connected to said second jack assembly, drive means connected to both said first and second shaft assemblies for simultaneous operation of both said shaft assemblies and therefore cause even raising and lowering movement of said seat, said drive means located rearwardly and below said toilet bowl;

adjustment means connected to said first jack assembly, said adjustment means permitting movement of said first jack assembly relative to said fixed base, upon a desired location having been obtained by said first jack assembly on said fixed base said adjustment means being operable to fix the established position of said first jack assembly on said fixed base.

2. The combination as defined in claim 1 wherein:

said adjustment means comprises an outermost opening and an innermost opening, said innermost opening comprising an elongated slot, a first fastener cooperating with said outermost opening, a second fastener cooperating with said innermost opening, both said fasteners connecting with said fixed base, said outermost opening being spaced from said first rotatable shaft with said innermost opening being located directly adjacent said first rotatable shaft, the adjusting movement of said first jack assembly being accomplished by loosening of both said fasteners and pivoting of said first jack assembly about said first fastener with said first jack assembly being slidingly moved relative to said second fastener.

3. The combination as defined in claim 2 including:

a protective cover means located about said adjustment mechanism.

* * * * *